US005370525A

United States Patent [19]

Gordon

[11] Patent Number: 5,370,525

[45] Date of Patent: Dec. 6, 1994

[54] MICROWAVE COMBUSTION ENHANCEMENT DEVICE

[75] Inventor: Charles E. Gordon, Reynoldsburg, Ohio

[73] Assignee: Blue Pacific Environments Corporation, Reynoldsburg, Ohio

[21] Appl. No.: 35,071

[22] Filed: Mar. 22, 1993

[51] Int. Cl.[5] ..... F23D 11/44

[52] U.S. Cl. ..... 431/11; 431/2; 431/258

[58] Field of Search ..... 431/2, 11, 258

[56] References Cited

U.S. PATENT DOCUMENTS

| | | | |
|---|---|---|---|
| 3,934,566 | 1/1976 | Ward | 431/2 |
| 4,076,607 | 2/1978 | Zavitsanos et al. . | |
| 4,230,448 | 10/1980 | Ward et al. | 431/11 |
| 4,435,374 | 3/1984 | Helm, Jr. . | |
| 4,556,020 | 12/1985 | Hickling | 431/6 |
| 4,666,678 | 5/1987 | Lemelson . | |
| 4,702,808 | 10/1987 | Lemelson . | |
| 4,915,916 | 4/1990 | Ito et al. . | |
| 4,935,114 | 6/1990 | Varma . | |
| 4,975,164 | 12/1990 | Ravella et al. . | |
| 5,145,361 | 9/1992 | Kurzinski | 431/10 |
| 5,217,362 | 6/1993 | Thompson et al. | 431/11 |

*Primary Examiner*—Carroll B. Dority
*Attorney, Agent, or Firm*—James Creighton Wray

[57] ABSTRACT

Combustion is enhanced by positioning plural magnetrons around a burner, and directing microwaves into a combustion zone as air and fuel or air fuel and oxygen are swirled into the combustion zone. The microwaves excite carbon atoms in the fluidized fuel mixture and improve complete oxidizing of the fuel with increased flame temperatures and reduced noxious emissions.

17 Claims, 1 Drawing Sheet

MICROWAVE COMBUSTION ENHANCEMENT DEVICE

BACKGROUND OF THE INVENTION

It has long been known that incomplete combustion during the combustion process results in lower flame temperatures and inadequate vaporization and ignition of fuel, resulting in less efficient combustion of fuel, which greatly increases the output of carbon monoxide and other hazardous emissions.

A long felt need exists for a new and improved method and apparatus for greater efficiency in fuel usage and for reduction or elimination of hazardous products of combustion of fossil fuels during the ignition and combustion process of fuels when used in an industrial process. The enactment and more stringent enforcement of regulations governing the emission of hazardous compounds into the atmosphere have required technological improvement of the air cleansing devices heretofore used in industrial processes. Industries that consume fossil fuels include the cement and lime industry (kilns), the electric generating utilities (coal and fuel fired boilers), the asphalt industry (fuel fired aggregate dryers), and any other industry using fossil fuels in their industrial process. Many exhaust cleansing system now available to these industries do not have the efficiency that new air quality regulations will require.

A need exists for a burner system to reduce or eliminate the undesirable products at their source by improving the combustion process to a sufficient degree that these compounds are not generated by the combustion process.

SUMMARY OF THE INVENTION

The present invention is a microwave combustion enhancement method and apparatus which directs microwaves into the combustion zone of a fluid (gas, oil or pulverized material) for improving efficient combustion and deriving less harmful products of combustion.

The combustion enhancement microwave process and apparatus of the invention enhances the ignition and complete combustion of sprayed and blown pulverized, liquid and gaseous fuels by contacting the fuels in their fluid state and/or atomized state with microwave energy. The process and apparatus eliminate some, and decrease amounts of other, noxious or hazardous products of combustion formed when fossil fuels or waste are consumed within an industrial process. Results are improved by introducing oxygen into the combustion process, in controlled amounts relative to the amount of fuel and air entering the combustion process.

The flame enhancement microwave method and apparatus of the present invention decrease the amount of hazardous chemical compounds that any fossil fuel burning apparatus generates by stimulating the combustion process by supplying microwaves to fuels in a fluent or gaseous state, prior to ignition, greatly enhancing the efficiency of the combustion of said fuels, while simultaneously injecting the process with oxygen prior to ignition of the fuels, enhancing the formation of non-hazardous emissions from the combustion of the fuel, instead of hazardous emissions.

The combustion enhancement device of the present invention is a method and an apparatus that are created to reduce or eliminate the undesirable products at their source by improving the combustion process to a sufficient degree that those compounds are not generated by the combustion process. Incorporating the latest combustion technology from Air Products Corporation, called "Oxy-Fuel", a system that injects pure oxygen into the combustion process, the present combustion enhancement device treats with microwaves the gaseous fossil fuels just prior to and during ignition and combustion, while also injecting controlled amounts of oxygen into the process. The microwave radiation highly excites the gaseous fuel, allowing a complete and instantaneous ignition, an almost complete burn, and allows, with the injection of oxygen into the process, a greater amount of carbon dioxide formation, instead of carbon monoxide.

By inducing oxygen prior to ignition of the fuel, and by highly stimulating the electron movement in the carbon atoms contained in the fuel with microwaves, the completeness of the combustion process is enhanced measurably, and the production of hazardous gaseous emissions from the process is greatly reduced.

The present invention provides a new and improved method and apparatus for greater efficiency in full usage and for reduction or elimination of hazardous products of combustion of fossil fuels during the ignition and combustion process of said fuels when used in an industrial process.

The flame enhancement device of the present invention has a manufactured steel alloy burner breaching, with several microwave-generating magnetrons positioned around the burner, allowing the concentration of microwave energy on the gaseous fuel as it has been atomized and released by the burner. The apparatus further has a control system, sensing fuel delivery rate to the burner, and controlling a valve which emits more or less oxygen into the fuel atomization process being controlled by the burner. As the oxygen-rich fuel mixture is atomized by the burner and is released into the vaporization area of the process, microwave energy contacts the atomized fuel, exciting the carbon atoms present, creating a highly combustible fuel, air and oxygen-rich mixture.

The breaching can be designed to be used with most existing equipment in the processes already utilizing such a burner, in the process. Additional engineering for retrofitting may be necessary on more complicated ignition systems, such as coal fired boilers, but most fuel oil or natural gas fuel fired processes may be retrofitted with the flame enhancement device, without major renovation.

Combustion is enhanced by positioning plural magnetrons around a burner, and directing microwaves into a combustion zone as air and fuel mixed with oxygen are swirled into the combustion zone. The microwaves excite carbon atoms in the fluidized fuel mixture and improve complete oxidizing of the fuel with increased flame temperatures and reduced noxious emissions.

A preferred burner has a fuel inlet line for supplying fuel to a combustion zone, an air inlet for supplying air to the combustion zone, and a microwave generator for supplying microwaves to the combustion zone for aiding combustion in the combustion zone.

The burner further has spin vanes as on existing burners for spinning and mixing air and fuel before the combustion zone.

Preferably an oxygen line is connected to the burner for supplying oxygen to the burner.

In a preferred embodiment, a fuel-oxygen mixing valve is connected to the fuel line and connected to the oxygen supply line for mixing the fuel and oxygen. An output fuel line for fuel and oxygen is connected to the fuel-oxygen mixing valve for supplying the fuel-oxygen mixture from the valve to the combustion zone.

Preferably the fuel line extends a center of the burner, and the air inlet surrounds the fuel line. Plural microwave generators positioned around the air inlet and direct microwaves into the combustion zone.

Preferably the burner is cylindrical and the outlet extends centrally through the burner. The combustion air inlet surrounds the outlet. The invention has vortex spin vanes between the outlet and the air inlet and the combustion zone. A circular plate is connected to the cylindrical burner. The microwave generators comprise four magnetrons connected to the plate at equally spaced positions on the plate, and oriented with respect to the plate for focusing microwave energy in the combustion zone.

A preferred combustion enhancement apparatus includes a mount placed adjacent a fluid fuel burner for mounting the burner, and a microwave generator connected to the mount for positioning adjacent the burner and for directing microwaves into a combustion zone near the burner.

Preferably the mount is an annular plate, and the burner Is connected centrally to the annular plate. A fuel outlet line extends through the burner and opens near the combustion zone. A combustion air inlet surrounds the fuel outlet line and opens near the combustion zone.

The preferred annular plate is a circular plate with a central circular opening for receiving one end of a cylindrical burner. Multiple magnetrons are mounted on the circular plate and are spaced equally from the burner and from each other for directing microwaves into the combustion zone.

In a preferred embodiment, vortex spin vanes are mounted at the openings of the combustion air inlet and the fuel outlet for imparting vortex spinning to the air and fuel as they enter the combustion zone.

The preferred embodiment has a fuel-oxygen mixing valve connected to the fuel inlet, an oxygen line connected to the valve and a fuel line connected to the valve for supplying oxygen and fuel to the valve, mixing oxygen and fuel in the valve, and supplying the oxygen fuel mixture to the fuel outlet. The fuel-oxygen-air vortex and the microwaves converge in the combustion zone.

The preferred combustion method supplies fuel and air to a combustion zone, directs microwaves into the combustion zone, and combusts the fuel and air mixture in the microwave environment.

Carbon is excited by the microwave within the combustion zone. Oxygen and fuel are mixed and the oxygen-fuel mixture is supplied to the combustion zone. A vortex is formed in the combustion zone by spinning air and fuel as they enter the combustion zone. Microwaves are directed into the combustion zone, from plural magnetrons surrounding the burner.

These and further and other objects and features of the invention are apparent in the disclosure, which includes the above and ongoing written specification, with the claims and the drawings.

DETAILED DESCRIPTION OF THE DRAWINGS

Figure 2:
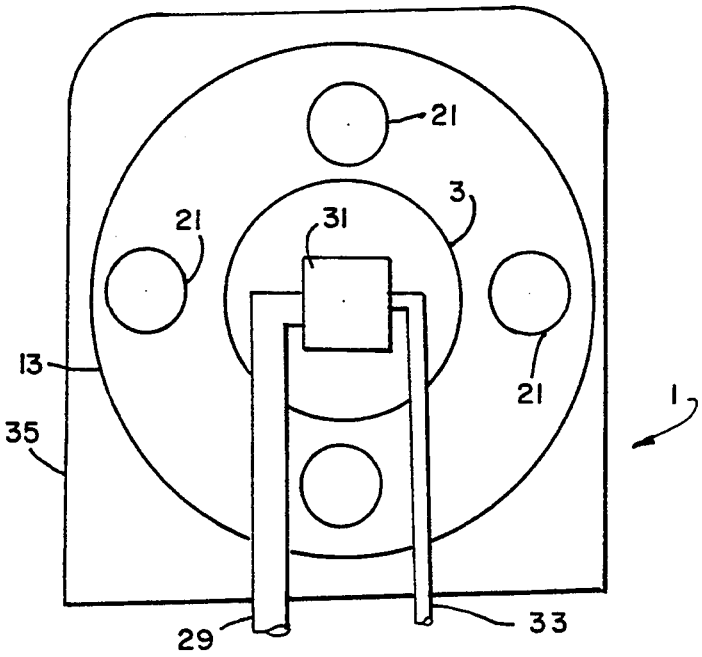
FIG. 2 is a schematic end view of the combustion enhancement device shown in FIG. 1.
Figure 1:
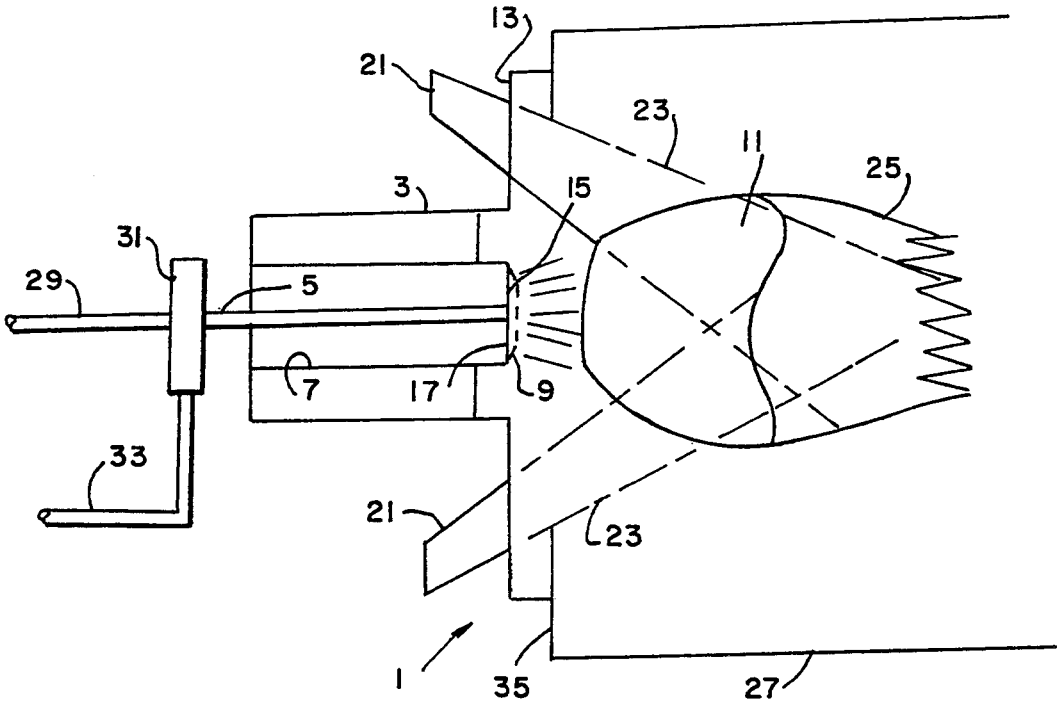
FIG. 1 is a schematic side elevational cross-section of the combustion enhancement device of the present invention.

The preferred combustion enhancement burner apparatus of the present invention is generally indicated by the numeral 1 in FIGS. 1 and 2. A cylindrical burner 3 has a fuel outlet line 5 and a surrounding combustion air inlet 7. Vortex burner spin vanes 9 spin the air and fuel and deliver an intimate mixture into the combustion zone 11. An annular mounting plate 13 surrounds the burner 3, the openings 15 of the fuel outlet line 5 and the openings 17 of the combustion air inlet 7. Microwave generators 21 are mounted on the annular mounting plate 13 for directing microwaves 23 into the combustion zone 11. The microwaves excite and preheat carbonaceous elements in the fuel mixture before, during and after combustion, and in the flame 25 to improve and complete combustion, and provide highest thermal output from the lowest amount of fuel for economy of fuel usage, and for reduction of exhaust products and reduction of noxious and hazardous products in the exhaust.

The combustion zone 11 and flame 25 occur in the fire box 27 of a heater or furnace, which may be used in power generation or as a kiln, a dryer or an incinerator. The incoming fuel line 29 may be a source of liquid fuel such as fuel oil, or gaseous fuel such as natural gas, or other fluid or fluent combustible materials such as pulverized coal, bituminous coal, lignite or brown coal, or pulverized or comminuted waste materials, either independently or mixed with other fuels.

In a preferred embodiment of the invention, a fuel-oxygen mixing valve 31 is connected between the fuel line 29 and the fuel outlet line 5. An oxygen supply line 33 is connected to the fuel-oxygen mixing valve 31 to mix oxygen with the fuel incoming from line 29 before the fuel and oxygen mixture is released to the fuel outlet line 5 for delivery to the combustion zone 11.

As shown in FIG. 2, in the preferred form the mounting plate 13 is an annular disc surrounding a cylindrical burner housing 3. Plural magnetrons 21, in this case four magnetrons, are equally spaced around the burner on the mounting plate 13 for directing microwaves at all angles in the combustion zone and for saturating the combustion zone 11 with microwaves. The preferred microwaves are centered on a frequency of about 2450 Mhz. The entire structure is mounted on a breaching 35, which exists at the end of the fire box 27.

While the invention has been described with reference to specific embodiments, modifications and variations of the invention may be constructed without departing from the scope of the invention, which is defined in the following claims.

I claim:

1. A burner comprising a fuel inlet line for supplying fuel to a combustion zone, an air inlet for supplying air to the combustion zone, and plural microwave generators for supplying microwave energy to a flame front of the combustion zone for aiding in complete fuel combustion in the combustion zone.

2. The apparatus of claim 1, wherein the burner further comprises spin vanes for spinning and mixing air and fuel before the combustion zone for complete fuel atomization.

3. The apparatus of claim 1, further comprising an oxygen line connected to the burner for supplying additional pure oxygen from an independent source to the burner.

4. The apparatus of claim 3, further comprising a fuel-oxygen mixing valve connected to the fuel line and connected to the oxygen supply line for mixing the fuel and oxygen, and an output connected to the fuel-oxygen mixing valve for supplying the fuel-oxygen mixture from the valve to the combustion zone for creating $CO_2$ at the flame front where the microwave energy is supplied.

5. The apparatus of claim 1, wherein the fuel line extends into a center of the burner, wherein the air inlet surrounds the fuel line, and wherein the plural microwave generators are positioned around the air inlet and wave guides for directing the microwave energy into the flame front of the combustion zone for enhancing combustion.

6. The apparatus of claim 5, further comprising a fuel-oxygen mixing valve connected to the fuel line, and an oxygen supply line connected to the fuel-oxygen mixing valve for mixing oxygen with the fuel, and an outlet connected to the fuel-oxygen mixing valve for supplying variable amounts of the mixed fuel and oxygen to the combustion zone, at a rate equal to 03:1 ratio of oxygen to fuel.

7. The apparatus of claim 6, wherein the burner is cylindrical and wherein the outlet extends centrally through the burner, wherein the combustion air inlet surrounds the outlet, and further comprising vortex spin vanes between the outlet and the air inlet and the combustion zone, and further comprising a circular plate connected to the cylindrical burner, and wherein the microwave generators comprise four magnetrons connected to the plate at equally spaced positions on the plate, and oriented with respect to the plate for focusing microwave energy in the flame front.

8. Combustion enhancement apparatus for placing adjacent a fluid fuel burner comprising a mount for mounting adjacent the burner, and plural magnetrons connected to the mount for positioning adjacent the burner and for directing microwaves into a flame front of the combustion zone near the burner.

9. The apparatus of claim 8, wherein the mount is an annular plate, and further comprising a burner connected to the annular plate, the burner having a fuel outlet line extending through the burner and opening near the combustion zone, and a combustion air inlet surrounding the fuel outlet line and opening near the combustion zone.

10. The apparatus of claim 9, wherein the annular plate further comprises a circular plate with a central circular opening for receiving one end of the burner, and further wherein the plural magnetrons are mounted on the circular plate and spaced equally from the burner and from each other for directing microwaves into the flame front.

11. The apparatus of claim 10, further comprising vortex spin vanes mounted at the openings of the combustion air inlet for imparting vortex spinning to the air and fuel as they enter the combustion zone.

12. The apparatus of claim 11, further comprising a fuel-oxygen mixing valve connected to the fuel outlet line, and an oxygen line connected to the valve and a fuel line connected to the valve for supplying oxygen and fuel to the valve, and for mixing oxygen and fuel in the valve, and supplying the oxygen fuel mixture to the fuel outlet line connected to the valve, wherein the fuel-oxygen air vortex and the microwaves converge in the combustion zone.

13. A combustion method comprising supplying fuel and air to a combustion zone, directing microwaves with plural magnetrons into a flame front of the combustion zone, and combusting the fuel and air mixture in the microwave environment.

14. The method of claim 13, further comprising exciting carbon by the microwaves within the combustion zone.

15. The method of claim 14, further comprising mixing oxygen and fuel and supplying the oxygen fuel mixture to the combustion zone.

16. The method of claim 14, further comprising forming a vortex in the combustion zone by spinning air and fuel by spin vanes as they enter the combustion zone.

17. The method of claim 14, wherein the directing of microwaves into the combustion zone further comprises surrounding a burner with the plural magnetrons and directing microwaves into a flame front of the combustion zone from the plural magnetrons surrounding the burner.

* * * * *